United States Patent [19]

Inglis

[11] Patent Number: 4,726,563

[45] Date of Patent: Feb. 23, 1988

[54] LOW FREQUENCY NOISE AND TURBULENCE REDUCER

[75] Inventor: Stephen C. Inglis, New Hartford, N.Y.

[73] Assignee: Carrier Corporation, Syracuse, N.Y.

[21] Appl. No.: 859,207

[22] Filed: Apr. 28, 1986

Related U.S. Application Data

[63] Continuation of Ser. No. 211,013, Nov. 28, 1980, abandoned.

[51] Int. Cl.[4] ..... F16K 47/02

[52] U.S. Cl. ..... 251/127; 251/298; 181/258; 98/38.2

[58] Field of Search ..... 137/625.28; 181/237, 181/258; 98/41 R; 251/127, 298; 98/38.2

[56] References Cited

U.S. PATENT DOCUMENTS

| | | | |
|---|---|---|---|
| 1,365,847 | 1/1921 | Pelton | 251/298 X |
| 3,283,694 | 11/1966 | Dean, Jr. | 181/258 |
| 3,669,349 | 6/1972 | Hall, Jr. | 236/13 |
| 3,699,871 | 10/1972 | Larkfeldt | 98/40 D |
| 3,750,839 | 8/1973 | McNabney | 181/50 |
| 4,100,938 | 7/1978 | Dravnieks et al. | 137/625.31 |
| 4,258,877 | 3/1981 | White | 236/49 |

FOREIGN PATENT DOCUMENTS

| | | | |
|---|---|---|---|
| 2550310 | 3/1977 | Fed. Rep. of Germany | 98/41 R |

*Primary Examiner*—Arnold Rosenthal
*Attorney, Agent, or Firm*—David J. Zobkiw

[57] ABSTRACT

Low frequency noise and turbulence are reduced in a damper structure by providing a perforate screen extension onto the damper blade so as to extend across the flow path when the damper is open. Additionally, a perforate screen is located immediately downstream of the damper and spaced from the wall so as to define a chamber therewith as well as defining a boundary of the flow path.

5 Claims, 3 Drawing Figures

| OCTAVE BANDS (CYCLES) | | | | | | | | | |
|---|---|---|---|---|---|---|---|---|---|
| | 63 | 125 | 250 | 500 | 1000 | 2000 | 4000 | 8000 | |
| RADIATED NOISE (SOUND POWER LEVEL) | 67 | 72 | 67 | 61 | 51 | 43 | 40 | 41 | NO SCREENS |
| | 65 | 67 | 62 | 58 | 49 | 43 | 41 | 40 | SCREEN ON DAMPER |
| | 67 | 70 | 64 | 56 | 46 | 39 | 38 | 31 | TOP SCREEN |
| | 64 | 63 | 59 | 54 | 44 | 38 | 39 | 32 | SCREEN ON DAMPER AND TOP SCREEN |

TESTS RUN AT 800 CFM, $P_s = 2$ INCHES OF WATER AND USING SCREENS WITH 3/16" DIA. X 1/4" ON CENTER PERFORATIONS

FIG. 3

LOW FREQUENCY NOISE AND TURBULENCE REDUCER

This application is a continuation of application Ser. No. 211,013 filed Nov. 28, 1980 and now abandoned.

BACKGROUND OF THE INVENTION

The present invention relates to damper structures and more specifically to the reduction of low frequency noise in damper structures.

Air flow structures such as dampers are subject to self-generated noise which is a function of the velocity and pressure of the delivered air as well as the structural details of the air distribution system. Various techniques have been employed to reduce noise generation. For example, air distribution systems have been lined with sound-absorbing materials, and diffusers in the form of perforate plates have been placed across the flow paths. These techniques have met with varying success. An excessive thickness of sound-absorbing materials is necessary to attenuate low frequency noise; perforate plates can cause excessive pressure drops and the low frequency noise can be reestablished in the recombined flow. Further, these techniques do not address the problem of noise production resulting from flow over the edges of sheet metal members.

SUMMARY OF THE INVENTION

The present invention reduces low frequency noise and turbulence in the damper structure by attaching a screen to the top portion of the damper blade. This requires the initial/last portion of the flow to pass through the screen rather than through a narrow slit. Additionally, a screen is placed downstream of the damper and essentially parallel to the air stream so as to break up the large eddies generated at the damper.

It is an object of this invention to provide an improved control unit for an air distribution system which can provide variable volume distribution without requiring a large amount of sound absorbing material to attenuate noise.

It is a further object of this invention to provide a damper assembly for an air distribution system which reduces low frequency noise and turbulence without causing excessive pressure drops. These objects, and others as will become apparent hereinafter, are accomplished by the present invention.

Basically, the present invention provides a perforate extension for the damper blade so that the flow path is never solely a narrow slit but rather is only through the perforations of the extension until the damper has opened sufficiently. Conversely, the flow path is only through the perforations when, in the closing of the damper, it is approaching what would be a narrow slit flow path in a conventional damper structure. Further, the wall of the air distribution system nearest the flow path in the opening and closing positions of the damper assembly is lined with a perforate screen which is spaced from the wall to define a chamber which reduces eddies and low frequency noise without providing a restriction in the flow path.

BRIEF DESCRIPTION OF THE DRAWINGS

For a fuller understanding of the present invention, reference should now be made to the following detailed description thereof taken in conjunction with the accompanying drawings wherein:

FIG. 3 is a table showing the effectiveness of the elements of the present invention alone and in combination.

DESCRIPTION OF THE PREFERRED EMBODIMENT

Figure 1:
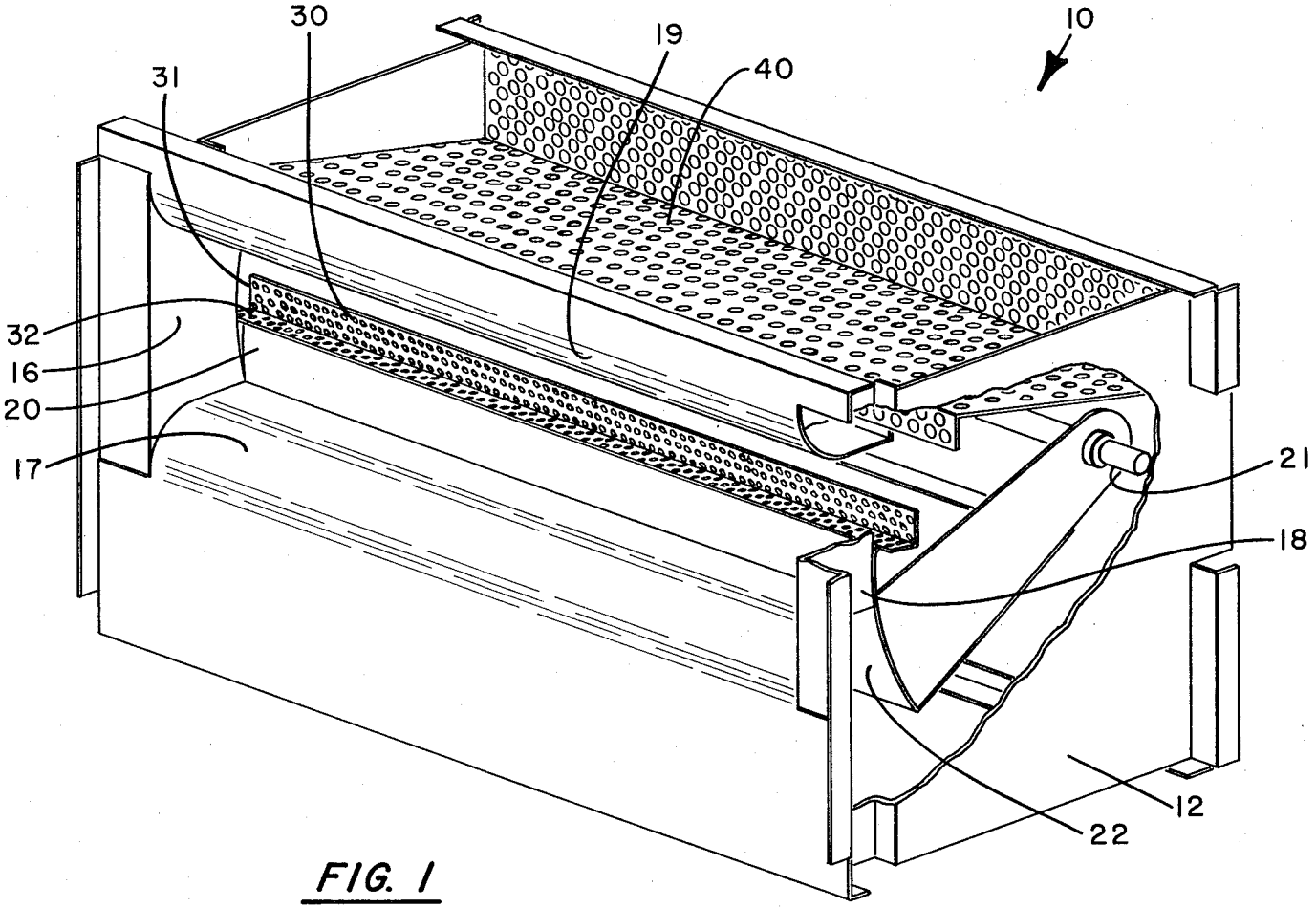
FIG. 1 is a partially cutaway pictorial view of a damper assembly incorporating the present invention.

Referring first to FIG. 1, the numeral 10 generally designates a damper assembly having a housing 12. The damper 20 is pivoted about rod 21 and includes a curved blade 22 which has a valving action with respect to the inlet defined by sheet metal members 16, 17, 18, and 19 which form a portion of the housing 12 of damper assembly 10. A perforated screen 30 is attached to and extends above blade 22.

Figure 2:
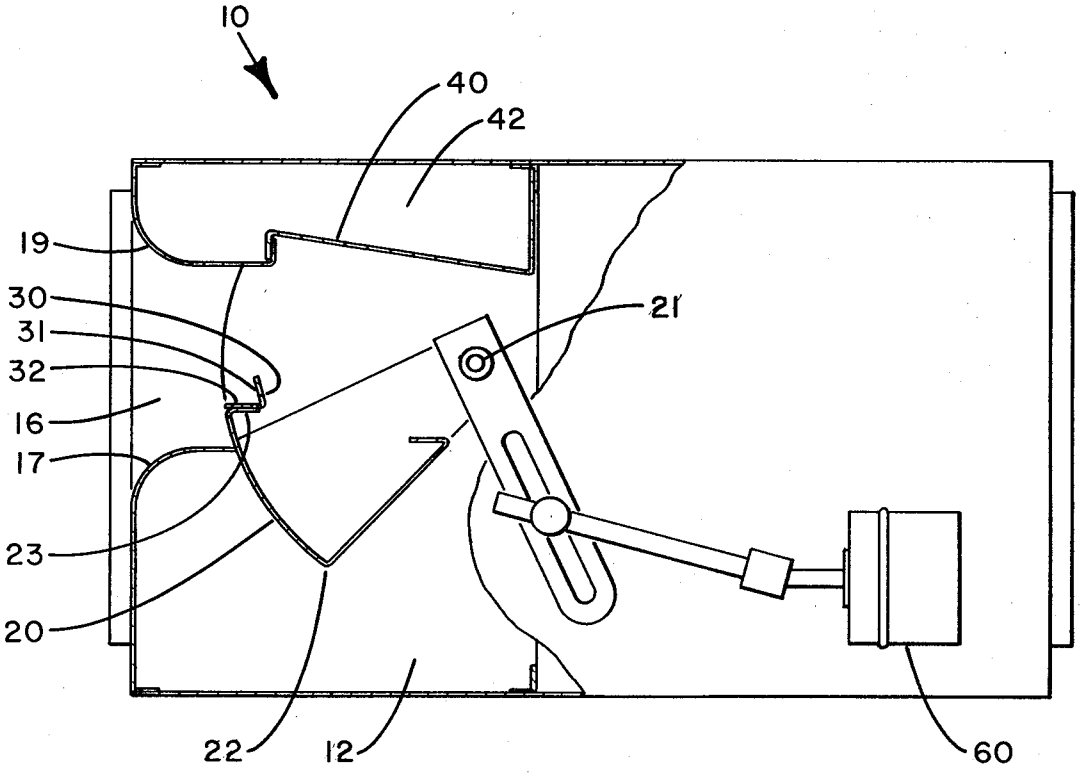
FIG. 2 is a longitudinal sectional view of the damper assembly in an air distribution system.

As best shown in FIG. 2, screen 30 is formed of two legs, 31 and 32, with a preferred included angle of 75°. Leg 32 of the screen 30 is attached to leg 23 of damper 20 so that leg 31 of the screen extends above the blade 22 for a distance of ½ inch to 1 inch with ¾ inch being preferred. The perforations are preferably 3/16 inch in diameter and on ¼ inch centers which form the apexes of equilateral triangles. The resultant porosity of screen 30 is 51% but this can be varied from about 35% to 65% with acceptable results. Leg 31 of screen 30 generally falls within a plus or minus 20° position from a plane taken perpendicular to the air flow as damper blade 22 moves from its fully open to its fully closed position when the included angle of legs 31 and 32 is 75°. The leading edge of leg 32 of the screen 30 is in alignment with the leading edge of blade 22. Screen 30 reduces the turbulence caused by the damper which in turn reduces the low frequency noise generated by such air turbulence. The size and porosity of leg 31 of screen 30 is critical. If leg 31 is less than ½ inch in height then there will not be enough holes in the screen to break up turbulence and some of the vortices shed will roll over the top of the screen. If the leg 31 is in excess of 1 inch in height it will extend too far into the air stream such that an excess pressure drop will be created and the air pressure acting on screen 30 will lift the blade 22.

A second screen 40 is located immediately downstream of the damper blade 22 such that air flow through the damper is over the screen 40. Flow through the damper 20 generates large eddies immediately downstream of the damper, however, the screen 40 and the chamber 42 partially defined thereby break up the large eddies thereby reducing the radiate noise levels. The porosity of screen 40 is not critical since the flow path is not through screen 40, but rather it must only provide a non-radiative surface for sound waves resulting from the eddies produced in flowing over the sheet metal edges of the damper. However, a porosity of 35%–65% provides acceptable results.

OPERATION

The damper 20 can be system powered wherein the position of blade 22 is determined by the inflation of two bellows indicative of the inlet static pressure and cooling demand from a bleed thermostat. Alternatively, the damper 20 may be positioned by a bellows responsive to the inlet static pressure and an external actuator such as an electric or pneumatic motor to move the blade 22 in response to cooling demand. Damper blade 22 may also be solely positioned by an electric or pneumatic motor 60 responsive to cooling demand as is illustrated in FIG. 2. Each of these standard modes of operation of the damper 20 would be conventional but for the air flow patterns and noise reduction caused by the screens 30 and 40. The leg 31 extends up from the damper blade 22 such that, depending upon the height of leg 31, the initial ½ to 1 inch of opening movement of blade 22 results in all of the air flow going through the perforations in leg 31 and then flowing over the perforate screen 40. The net result is a reduction in low frequency noise due to the resulting reduction in turbulence. Further opening movement of the damper blade 22 permits flow around leg 31 with a portion of the flow still going through the perforations of leg 31. However the air flow will still be over perforate screen 40 and therefore turbulence and the resultant low frequency noise will be reduced. Since this turbulence is a function of the flow restriction, the present invention limits the effectiveness of the restriction function of screen 30 by limiting it to only a portion of the flow path and by not having the flow path go through screen 40. Thus, at no time is restricted flow solely through a narrow slit defined in part by the edge of a sheet metal member forming a part of housing 12. With a damper system run at an air flow of 800 cfm and a static pressure of two inches of water, the individual and combined sound reduction properties of the screens 30 and 40 (measured as sound power levels) are shown in FIG. 3. For these comparisons, the perforations in the screens 30 and 40 were 3/16 inch in diameter and on ¼ inch centers such that the perforations form the apexes of equilateral triangles. It will be noted that in each case, at the lower octave bands, the best results occur when both screens are used.

Although a preferred embodiment of the present invention has been illustrated and described, other changes will occur to those skilled in the art. For example, the included angle of the legs of screen 30 is dependent upon the arc through which the damper blade travels since it is desirable to have leg 31 as perpendicular to the flow as possible over the entire range of movement so as to provide essentially the same flow resistance. It is therefore intended that the scope of the present invention is to be limited only by the scope of the appended claims.

I claim:

1. A control unit for an air distribution system comprising:

a housing having an inlet, an outlet and a flow path therebetween;

damper means mounted in said flow path and having an imperforate curved blade mounted for rotation about an axis transverse to said flow path for movement between a closed position preventing flow and open positions permitting flow and coacting with said inlet for controlling flow through said flow path in said open positions; and screen means separate from and attached to said blade and extending into said flow path when said blade is in said open positions whereby at least a portion of said flow path is through said screen means.

2. The control unit of claim 1 wherein said screen means extends from said blade for a distance between one half inch and one inch.

3. The control unit of claim 2 wherein said screen means has a porosity of approximately 35%–65%.

4. The control unit of claim 1 further including a second screen means mounted in said housing parallel to said flow path immediately downstream of said inlet and spaced from said housing so as to form a hollow chamber therewith whereby air flowing through said damper means flows over said spaced second screen means to break up eddy currents generated at the damper.

5. The control unit of claim 4 wherein said second screen means has a porosity of approximately 35–65%.

* * * * *